US007343647B1

(12) United States Patent
Kinskey et al.

(10) Patent No.: US 7,343,647 B1
(45) Date of Patent: Mar. 18, 2008

(54) DEVICE FOR HOLDING AND ORGANIZING ITEMS

(76) Inventors: Terry Kinskey, 1011 Tullamore Pl., Alpharetta, GA (US) 30022-8077; Matthew Williams, 1020 SE. 13th Ave., Deerfield Beach, FL (US) 33441-7112

( * ) Notice: Subject to any disclaimer, the term of this patent is extended or adjusted under 35 U.S.C. 154(b) by 0 days.

(21) Appl. No.: 11/056,070

(22) Filed: Feb. 11, 2005

Related U.S. Application Data

(60) Provisional application No. 60/544,457, filed on Feb. 13, 2004.

(51) Int. Cl.
*A44B 21/00* (2006.01)
*A45F 5/00* (2006.01)

(52) U.S. Cl. ..... 24/3.13; 24/481; 24/265 H; 16/406; 224/250; 224/268

(58) Field of Classification Search ..... 24/3.4, 24/3.12, 265 H, 265 AL, 481; 224/150, 224/600, 603, 250, 268; 16/406, 442, 426, 16/428; 119/795
See application file for complete search history.

(56) References Cited

U.S. PATENT DOCUMENTS

| | | | | |
|---|---|---|---|---|
| 3,947,927 | A | 4/1976 | Rosenthal | |
| 4,149,540 | A | 4/1979 | Hasslinger | |
| 4,273,130 | A | 6/1981 | Simpson | |
| 4,440,334 | A * | 4/1984 | Kappel et al. | 224/258 |
| 4,531,661 | A | 7/1985 | Santy | |
| 4,541,364 | A * | 9/1985 | Contello | 119/772 |
| 4,878,274 | A | 11/1989 | Patricy | |
| 5,005,266 | A | 4/1991 | Fister et al. | |
| 5,052,602 | A | 10/1991 | Duchi, Jr. et al. | |
| 5,110,023 | A | 5/1992 | Colin | |
| 5,207,363 | A | 5/1993 | Duchi, Jr. et al. | |
| 5,361,726 | A | 11/1994 | Harris et al. | |
| 5,511,756 | A | 4/1996 | Spradling | |
| 5,649,504 | A * | 7/1997 | Culp | 119/795 |
| 5,852,988 | A * | 12/1998 | Gish | 119/795 |
| 6,029,321 | A | 2/2000 | Fisher | |
| 6,273,029 | B1 * | 8/2001 | Gish | 119/795 |
| 6,286,190 | B1 * | 9/2001 | Friend et al. | 24/265 H |
| 6,338,463 | B1 | 1/2002 | Babitz et al. | |
| 6,345,418 | B1 | 2/2002 | Bertrand et al. | |
| 6,449,815 | B1 | 9/2002 | Spiller | |
| 6,553,944 | B1 | 4/2003 | Allen et al. | |
| 6,626,132 | B1 * | 9/2003 | Mann | 119/795 |
| 6,883,691 | B2 | 4/2005 | Pratt et al. | |
| 2005/0085350 | A1 | 4/2005 | Shen | |

* cited by examiner

*Primary Examiner*—Robert J. Sandy
(74) *Attorney, Agent, or Firm*—Myers & Kaplan, LLC; Joel D. Myers; George P. Bonanto

(57) ABSTRACT

A device for holding and organizing items includes an anchor for fastening the device to an object; a strap adapted to secure the items to the device; and a connector, having an upper piece and a lower piece that pivot relative to one another, the upper piece being connected to the anchor and the lower piece being connected to the strap.

10 Claims, 1 Drawing Sheet

DEVICE FOR HOLDING AND ORGANIZING ITEMS

CROSS REFERENCES TO RELATED APPLICATIONS

This application claims priority from U.S. Provisional Application Ser. No. 60/544,457 filed Feb. 13, 2004, the entire disclosure of which is incorporated herein by this reference.

FIELD OF THE INVENTION

The present invention relates to organizational accessories, and, more particularly, to a device for holding and organizing items.

BACKGROUND OF THE INVENTION

When storing items in a space, such as a garage or an attic, it is desirable to organize the items to maximize the use the space and to allow for rapid location and retrieval of a desired item. Shelving is one example of a system that may be used for storing items in an organized manner. Shelves may be secured to walls or constructed on the floor of a storage space to accommodate various items; however, shelving is rarely capable of accommodating large or irregularly shaped items, such as pieces of lawn furniture or lumber. Additionally, once installed, shelving is cumbersome to rearrange or adapt when storage of differently sized items at different locations within the storage space is desired. Also, shelving often does not provide means for using a ceiling to support stored items. Furthermore, with regard to items stored on high shelves, the shelves themselves often block the line of sight between an individual standing on the floor of a storage space and the stored items making it difficult to rapidly locate and retrieve a desired item. Accordingly, there remains a need in the art for a device which satisfactorily addresses the above-identified problems.

SUMMARY OF THE INVENTION

The present invention meets the above-identified needs, and others, by providing a device for holding and organizing items, which includes an anchor, a connector and a strap. The anchor fastens the device to a desired object, for example, a beam or hook on a ceiling or a wall; the connector joins the anchor to the strap; and the strap secures the device to one or more items, for example, a hand tool, an extension cord, a tool bag, a board, or a piece of lawn furniture.

In an exemplary embodiment of the device, the anchor includes a substantially C-shaped body and a gate, which is pivotally attached to the body, the gate having an open position and a closed position. While in the open position, the body of the anchor may be attached to or removed from an object; while in the closed position, the anchor may neither be attached to nor removed from the object.

An exemplary connector generally includes two pieces that pivot relative to one another, an upper piece, joined to the anchor, and a lower piece, joined to the strap. The upper piece has an O-shaped portion, defining an opening through which the body of the anchor may be hooked to join the connector to the anchor, and a leg, extending downwardly from the O-shaped portion and terminating at a foot. The lower piece of the connector is generally D-shaped, the apex of the curved portion of the "D" defining an aperture adapted for receiving the leg of the upper piece, which is pivotable within the aperture but prevented from slipping through the aperture by the foot, i.e., the lower piece hangs on the foot of the upper piece. The straight portion of the hanging D-shaped lower piece of is used for supporting the strap of the device.

An exemplary strap includes a sleeve, which is placed around the straight portion of the "D," thereby joining the strap to the connector. The strap includes a first and a second band, extending from either side of the sleeve. An outer surface of the first band and an inner surface of the second band are preferably provided with mating attachment means, such as hook-and-loop fasteners, snaps, or a belt-buckling system. In this regard, the two bands may be wrapped around one or more items, or a portion of the one or more items, and attached to one another, thereby securing the items to the device. By fastening the anchor to an object at a desired location within a storage space, such a beam on a ceiling, and securing one or more items to the device using the strap, the items may be stored at the desired location.

DESCRIPTION OF THE INVENTION

Figure 1:
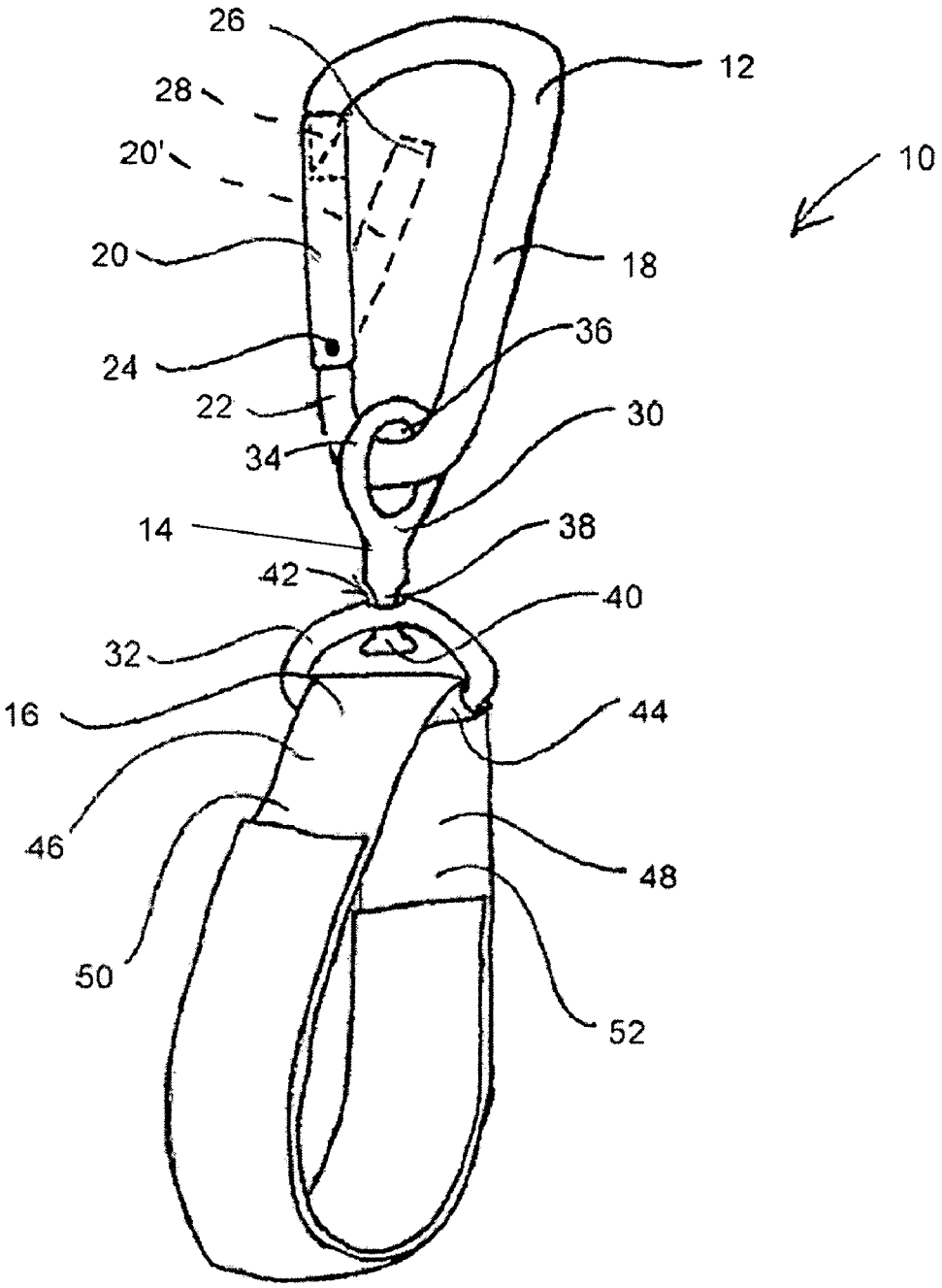
FIG. 1 is a perspective view of an exemplary device for holding and organizing items made in accordance with the present invention.

The present invention is a device for holding and organizing items. With reference to FIG. 1, an exemplary device 10 generally includes an anchor 12, a connector 14 and a strap 16. The anchor 12 is primarily used to fasten the device 10 to an object, for example, a beam or hook on a ceiling or a wall. The connector 14 is primarily used to join the anchor 12 to the strap 16. The strap 16 is primarily used to secure the device 10 to one or more items, for example, a hand tool, an extension cord, a tool bag, a wooden board, or a piece of lawn furniture. It is contemplated that the anchor 12 and the connector 14 are constructed from a substantially rigid and durable material, for example, metal or a polymer having similar characteristics, while the strap 14 is constructed from a substantially flexible and durable material, for example, nylon, leather, or PP webbing.

As shown in FIG. 1, in this exemplary embodiment, the anchor 12 includes a substantially C-shaped body 18 and a gate 20, which is pivotally secured to a first end 22 of the body 18 so as to rotate about an axis 24. When the gate 20 is in an open position, shown in phantom and indicated by reference numeral 20', the body 18 of the anchor 12 may be attached to or removed from an object. When the gate 20 is in the closed position, a free end 26 of the gate 20 engages a second end 28 of the body 18, such that the anchor may neither be attached to nor removed from an object. Since a spring (not shown) is provided to urge the gate 20 into a closed position, opening the gate 20 requires that an individual apply pressure to the gate 20. Thus, once the anchor 12 has been fastened to an object, it remains fastened thereto until an individual applies pressure to the gate 20 and removes the anchor 12 from the object.

The connector 14 generally includes two pieces that pivot relative to one another, an upper piece 30 joined to the anchor 12 and a lower piece 32 joined to the strap 16. In the exemplary embodiment shown in FIG. 1, the upper piece 30 has a unitary construction, but may be described with reference to its components, including an O-shaped portion 34 defining an opening 36 through which the body 18 of the anchor 12 may be hooked to join the connector 14 to the anchor 12. The upper piece 30 additionally includes a leg 38, extending downwardly from the O-shaped portion 34 and terminating at a foot 40.

The lower piece 32 of the connector 14 is generally D-shaped, the apex of the curved portion of the "D" defining an aperture 42 adapted for receiving the leg 38 of the upper piece 30. The aperture 42 is of a size sufficient to allow the leg 38 to freely pivot therein, but insufficient to allow the foot 40 to pass therethrough. As such, the two pieces of the connector 14 are linked to one another, with the D-shaped lower piece 32 hanging on the foot 40 of the upper piece 30. The straight portion of the hanging D-shaped lower piece 32 of the connector 14 is used for supporting the strap 16 of the device 10. In the exemplary embodiment of the device 10 depicted in FIG. 1, the strap 16 includes a sleeve 44, which is placed around the straight portion of the "D," thereby securing the strap to the connector 14.

The strap 16 may be further described with reference to two integral portions, a first band 46 extending from the sleeve 44 in one direction and a second bands 48 extending from the sleeve 44 in another direction. An outer surface 50 of the first band 46 and an inner surface 52 of the second band 48 are preferably provided with mating attachment means, such as hook-and-loop fasteners, snaps, or a belt-buckling system. In this regard, the two bands 46, 48 may be wrapped around one or more items, or a portion of the one or more items, and attached to one another, thereby securing the items to the device 10. Of course, the size, design and dimensions of the strap 14 may be adapted based on the item sought to be secured to the device 10; for example, in order to secure several tennis balls, the strap may be designed to be a net that cradles and secures the tennis balls to the device.

Similarly, it should be noted that the anchor 12 of the device 10 may be designed to be fastened to any substantially fixed object, and the strap 16 may be designed to be secured to any item without departing from the spirit and scope of the present invention. The manner in which the device of the present invention is used is further illustrated by the following specific but non-limiting examples.

EXAMPLE 1

Storing Items Using a Single Device

Several extension cords are being stored in an attic. The extension cords are coiled, the bands 46, 48 of the strap 16 are wrapped around the coils, and the bands 46, 48 are attached to one another. The anchor 12 of the device 10 is fastened to a beam on a ceiling of the attic allowing the extension cords to be conveniently hung from the ceiling in an organized compacted coiled formation, in plain view, while maximizing the use of space within the attic.

EXAMPLE 2

Storing Items Using More than One Device

Several long wooden boards are being stored in a garage. The bands 46, 48 of the strap 16 of one device 10 are wrapped around one end of the boards, while the bands 46, 48 of another structurally identical device 10 are wrapped around another end of the boards. The anchors 12 of each device 10 are fastened to hooks on the wall of the garage allowing the boards to be conveniently stored in plain view, while maximizing the use of space within the garage.

EXAMPLE 3

Storing Items in Tiers Using More than One Device

Several long and cumbersome ladders are being stored in a facility. The bands 46, 48 of the strap 16 of a first device 10 are wrapped around one end of a first ladder, while the bands 46, 48 of a second device 10 are wrapped around another end of the first ladder. The anchors 12 of each device 10 are fastened to beams on the ceiling of the facility.

The bands 46, 48 of the strap 16 of a third device 10 are wrapped around one end of a second ladder, while the bands 46, 48 of a forth device 10 are wrapped around another end of the second ladder. The anchors 12 of the third and fourth devices 10 are fastened to desired portions of the first and second devices 10, respectively, such that the second ladder hangs below the first ladder.

Additional ladders may be hung in a like manner using additional devices 10, allowing the plurality of ladders to be conveniently stored in plain view in a tiered arrangement, maximizing the use of space within the facility.

EXAMPLE 4

Holding Items for Convenient Access Using a Device

Convenient access from a ladder to a variety of tools is desired. The bands 46, 48 of the strap 16 are attached to the handle a case for holding a variety of hand tools. The anchor 12 of the device 10 is attached to the ladder, thereby allowing access to the tools while working from the ladder.

EXAMPLE 5

Storing Multiple Items Using an Alternate Device

A grouping of sports equipment, including baseballs and a baseball glove, are being stored in a garage. A device of the present invention is provided, the device having a strap designed as a mesh net having a drawstring opening. The drawstring opening is adjusted to allow the baseball glove and other sports equipment to pass into the net and again adjusted to keep the equipment from falling out of the net. The anchor of the device is fastened to a hook on the wall of the garage, allowing the equipment to be to be conveniently stored in plain view, while maximizing the use of space within the garage.

It will be obvious to those skilled in the art that further modifications may be made to the embodiments described herein without departing from the spirit and scope of the present invention.

The invention claimed is:

1. A device for holding and organizing one or more items, comprising:

an anchor for fastening the device to an object;

a connector, having an upper piece and a lower piece that pivot relative to one another, said upper piece being joined to said anchor; and a strap joined to the lower piece of said connector and adapted to secure the one or more items to the device, wherein said anchor includes a body and a gate that pivots between an open position, wherein said anchor may be attached to or removed from said object, and a closed position, wherein said anchor may neither be attached nor removed from said object, and wherein the lower piece of said connector is generally D-shaped with a curved portion and a straight portion, the aperture defined in the curved portion and the straight portion being joined to said strap.

2. The device of claim 1, wherein the upper piece of said connector includes a leg connected to a foot, and the lower piece of said connector defines an aperture adapted for receiving the leg, the leg pivotable within the aperture but prevented from slipping through the aperture by the foot.

3. The device of claim 2, wherein the upper piece of said connector defines an opening through which a portion of said anchor may be hooked to join said connector to said anchor.

4. The device of claim 3, wherein said strap comprises two integral bands provided with mating attachment means, such that the two bands may be wrapped around one or more items and secured to one another, thereby securing the items to the device.

5. The device of claim 1, wherein said strap further includes a sleeve fastened around the straight portion of the lower piece of said connector, thereby securing said strap to said connector.

6. The device of claim 1, wherein said strap comprises two integral bands provided with mating attachment means such that said two bands may be wrapped around one or more items and secured to one another, thereby securing the items to said device.

7. A device for holding and organizing items, comprising:

an anchor for fastening the device to an object;

a connector, having an upper piece joined to said anchor and including a leg terminating in a foot, and a lower piece defining an aperture for receiving said leg such that it is pivotable within said aperture but prevented from slipping through said aperture by the foot; and a strap joined to the lower piece of said connector and adapted to secure the items to the device, wherein said strap comprises two integral bands provided with mating attachment means, such that said two bands may be wrapped around one or more items and secured to one another, thereby securing the items to said device, and wherein the lower piece of said connector includes a straight portion and said strap further includes a sleeve fastened around the straight portion, thereby securing said strap to said connector.

8. The device of claim 7, wherein said anchor includes a body and a gate that pivots between an open position, wherein said anchor may be attached to or removed from the object, and a closed position, wherein said anchor may neither be attached to nor removed from the object.

9. The device of claim 8, wherein the upper piece of said connector defining an opening through which the body of said anchor may be hooked to join said connector to said anchor.

10. A device for holding and organizing items, comprising:

an anchor for fastening the device to an object and including a body, and a gate that pivots between an open position, wherein said anchor may be attached to or removed from the object, and a closed position, wherein said anchor may neither be attached to nor removed from the object, a connector, having an upper piece defining an opening through which the body of said anchor may be hooked and including a leg terminating in a foot, and a lower piece being generally D-shaped and including a straight portion; and a curved portion defining an aperture for receiving the leg of the upper piece such that it is pivotable within the aperture but prevented from slipping out of the aperture by the foot; and a strap comprising two integral bands provided with mating attachment means, such that the two bands may be wrapped around one or more items and secured to one another, thereby securing the items to the device; and a sleeve fastened around the straight portion of the D-shaped lower piece, thereby joining said strap to said connector.

* * * * *